United States Patent [19]

Dickinson et al.

[11] Patent Number: 4,701,107

[45] Date of Patent: Oct. 20, 1987

[54] TWO STAGE PUMP SAMPLER

[75] Inventors: W. David Dickinson, Medina, N.Y.; Charles N. Baetz, Ann Arbor, Mich.

[73] Assignee: American Sigma, Inc., Middleport, N.Y.

[21] Appl. No.: 848,243

[22] Filed: Apr. 4, 1986

[51] Int. Cl.[4] ..... F04B 23/14; F04B 43/08; F04F 1/06

[52] U.S. Cl. ..... 417/86; 417/118; 417/478

[58] Field of Search ..... 417/86, 85, 90, 118, 417/394, 478

[56] References Cited

U.S. PATENT DOCUMENTS

| | | | |
|---|---|---|---|
| 430,436 | 6/1890 | Richardson | 417/86 X |
| 949,681 | 2/1910 | Krogh | 417/86 |
| 1,642,211 | 9/1927 | Langdon | 417/86 |
| 3,963,377 | 6/1976 | Elliott et al. | 417/394 X |
| 3,991,825 | 11/1976 | Morgan | 417/118 X |
| 4,373,867 | 2/1983 | Campbell | 417/478 X |
| 4,489,779 | 12/1984 | Dickinson et al. | 417/394 X |
| 4,580,952 | 4/1986 | Eberle | 417/478 X |

*Primary Examiner*—Carlton R. Croyle
*Assistant Examiner*—Paul F. Neils
*Attorney, Agent, or Firm*—Irving M. Weiner; Joseph P. Carrier; Pamela S. Burt

[57] ABSTRACT

A bladder pump is suspended in a tubular air lift pump housing which is closed at its lower end by a check valve, and which is connected at its upper end by a first conduit and a separator selectively to a supply of air under pressure. Two additional conduits extend from the upper end of the bladder pump in either side-by-side relation, or coaxially one within the other, through the bore in the left pump housing and first conduit and the separator to control means. A first one of the two additional conduits is secured in the upper end of the bladder pump to communicate with an upper check valve chamber, which is connected by a perforated discharge tube to a lower check valve chamber in the bladder pump. The discharge tube is surrounded by a flexible bladder, which is separated from the bladder pump housing by an air chamber which communicates with the other of the two additional conduits to the control means. By supplying air under pressure through the first conduit water which has entered the air lift housing through the check valve in its lower end, can be forced through the check valve and bladder pump and first of the two additional conduits to a waste line, after which pumping air can be supplied intermittently to the second of the additional conduits to operate the bladder and pump water to a sampler through the first of the additional conduits.

18 Claims, 5 Drawing Figures

TWO STAGE PUMP SAMPLER

BACKGROUND OF THE INVENTION

This invention relates to an improved fluid sampler device, and more particularly to an improved sampler having a novel two stage pump of the combined air lift and bladder pump variety.

There are currently available a variety of fluid sampling devices which incorporate a single stage pump for sampling groundwater and the like. By way of example, reference is made to U.S. Pat. No. 4,489,779, which discloses a sampler device that utilizes a single stage bladder pump in a well casing for purging and then withdrawing fluid samples from the well. For certain types of wells it has also been customary heretofore to support a bladder pump of this type in a well casing in side-by-side relation to a separate, air lift pump, which is used for purging stale well water from the casing, after which the bladder pump is operated to collect the desired samples.

One of the disadvantages of the devices which utilize both bladder and air lift pumps is that, by virtue of the fact that the bladder pump and air lift pump are mounted separately from one another, or side-by-side in a well casing, the cost of producing and controlling the two separate pumps is relatively high, and also requires that the diameter of the associated well casing into which they are inserted be at least large enough to accommodate the pumps in side-by-side relation. Moreover, depending upon the depth of the respective well into which such equipment is to be inserted, separate provisions must be made for extending the lengths of the fittings for each pump.

It is an object of this invention, therefore, to provide an improved sampler which utilizes a coaxially disposed two stage pump, which incorporates both an air lift pump and a bladder pump, in a single casing, thus enabling the sampler to be employed in relatively small diameter well casings, as compared to known samplers.

Still another object of this invention is to provide for samplers of the type described a novel two stage pump, which is relatively simple and inexpensive to manufacture, and which is readily extensible to suit various well depths.

Other objects of the invention will be apparent hereinafter from the specification and from the recital of the appended claims, particularly when read in conjunction with the accompanying drawings.

SUMMARY OF THE INVENTION

The sampler comprises a tubular air lift housing closed at its lower end by a check valve, and connected at its upper end through a first conduit and a separator to a first valve, which is selectively operable to supply air under pressure to the interior of the tube. Secured at one end to the separator and extending at their opposite ends through the bore in the first conduit in either side-by-side relation, or coaxially one within the other, are two additional tubular conduits, the first of which extends downwardly in the bore in the air lift housing and is operatively connected to the upper end of the tubular housing of a bladder pump, which is suspended just above the check valve that closes the lower end of the air lift housing.

The second of the two additional conduits also extends downwardly in the bore of the air lift housing and is secured in the upper end of the bladder pump to communicate with an upper check valve chamber, which is connected by a perforated discharge tube to a lower check valve chamber in the bladder pump. The discharge tube is surrounded by a flexible bladder, which is separated from the outer bladder pump housing by an air chamber which communicates with the first of the two additional conduits.

In use the tubular air lift housing is inserted to a predetermined depth in a well casing and air under pressure is supplied intermittently through the separator to the first conduit, thereby causing water, which has entered the air lift housing through the check valve in its lower end, to be forced intermittently through the check valve chamber in the lower end of the bladder pump, and then upwardly through the upper check valve chamber and the second of the two additional conduits, and the separator to a waste line, thereby effectively purging the stale well water for several pumping cycles by virtue of the air lift section of the two stage pump.

Thereafter the first conduit is shut off and a compressed air supply (alternately with a vacuum supply) is intermittently applied to the first of the two additional conduits thereby intermittently increasing and decreasing the pressure in the space between the bladder and the outer housing of the bladder pump, and consequently causing the fluid to be pumped thereby upwardly through the discharge tube and the second of the two additional conduits to a sample collector connected to an outlet of the separator.

THE DRAWINGS

DETAILED DESCRIPTION OF THE PREFERRED EMBODIMENTS

Figures 1, 2, 3, 5:
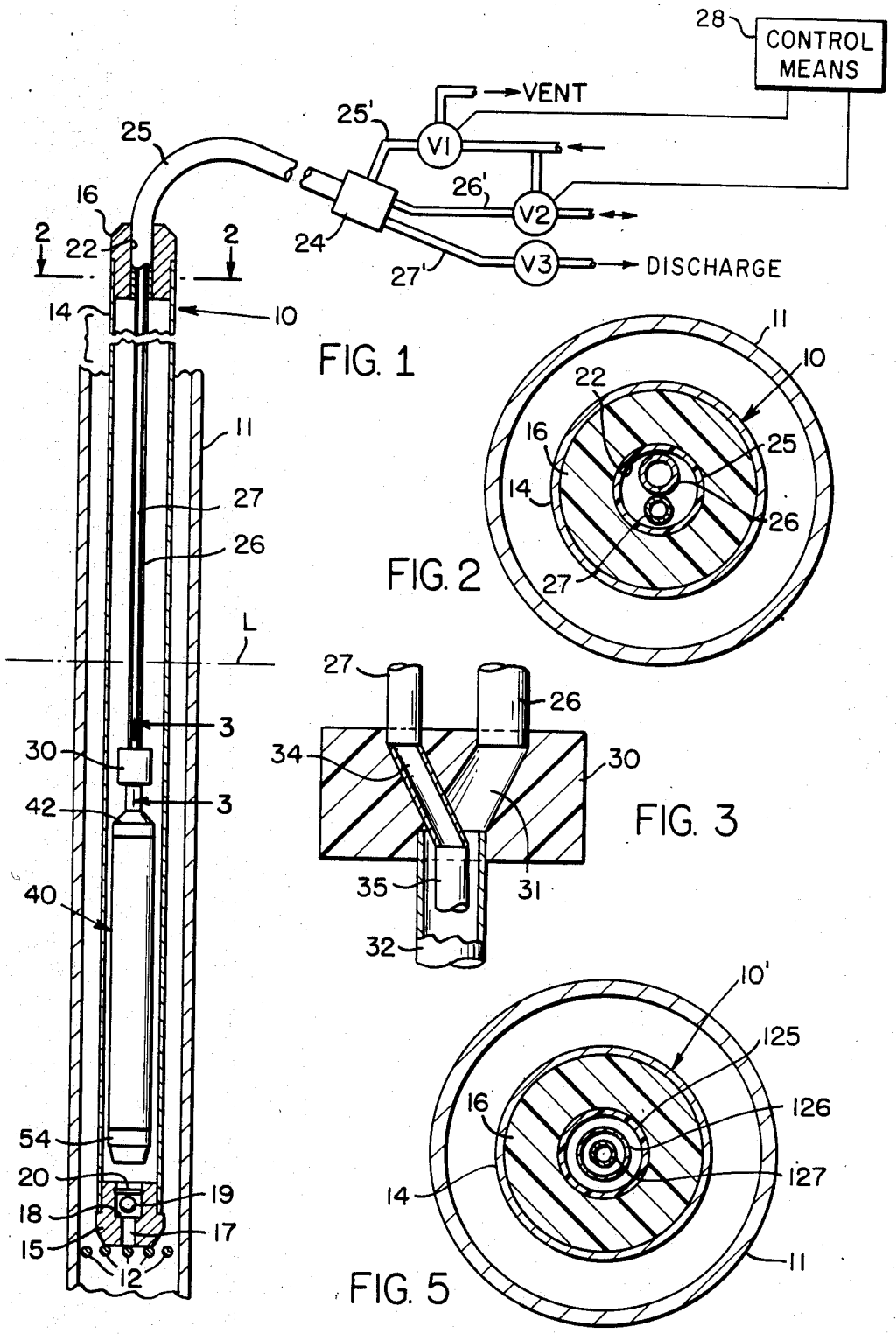
FIG. 1 is a fragmentary elevational view illustrating partially in longitudinal section, and partially in full, a two stage pump sampler made according to one embodiment of this invention, the sampler being shown as it appears when it is mounted in a well casing.
FIG. 2 is an enlarged, fragmentary sectional view taken along the line 2—2 in FIG. 1.
FIG. 3 is an enlarged, fragmentary sectional view taken along the line 3—3 in FIG. 1.
FIG. 5 is a view similar to FIG. 2 but showing a modified form of the sampler.

Referring now to the drawings by numerals of reference, and first to FIG. 1, 10 denotes generally a novel, two stage pump mounted in a conventional well casing 11, and with the lower end of the pump seated on a screen that is formed by a plurality of rods or bars 12 that extend transversely across the bore in the well casing.

Pump 10 comprises an outer, tubular or cylindrical housing 14, which is closed at its lower end by a cylindrical check valve housing 15, and its upper end by a cylindrical plug or conduit support 16. The valve housing 15 has in its lower end a coaxially disposed fluid inlet bore or port 17, which communicates with an enlarged-diameter counterbore 18 that is formed in the upper or inner end of housing 15 coaxially of port 17. Mounted for limited axial movement in the counterbore 18 is a circular ball valve or check valve 19, which has a diameter larger than the diameter of the bore 17, but slightly smaller than the counterbore 18. Valve 19 is retained in the counterbore by a plurality of spaced, parallel bars or rods 20, which extend transversely cross the counterbore 18 adjacent its upper end.

Secured at one end in an axial bore 22 in the housing plug 16, and at its opposite end in a conventional fluid distributor or separator 24, is a plastic conduit or purging tube 25. Also secured each at one end to separator 24, and extending at their opposite ends through the bore in the purging tube 25 and into the bore of housing 14 are two additional tubular conduits 26 and 27 (FIGS. 1 and 2). Conduits 26 and 27 extend axially downwardly beneath the end of housing plug 16 in spaced, parallel relation to each other and to the inner bore of the surrounding pump housing 14.

Secured to and suspended from the lower ends of the conduits 26 and 27 adjacent the lower end of housing 14 is a twin tube adaptor 30 (FIGS. 1 and 3). Adaptor 30 has therethrough a bore 31 (FIG. 3) which is secured at its upper end to the lower end of conduit 26, andat its lower end to the upper end of a metal sleeve 32 that is secured in the underside of adaptor 30 in communication with bore 31. Adaptor 30 also contains a tubular conduit 34 (FIG. 3), which is secured at its upper end to the lower end of conduit 27, and extends at its lower end into the center of the bore 31 in the adaptor. Another tube 35, which is smaller in diameter than sleeve 32, is secured at its upper end to the lower end of the sleeve conduit 34, and extends coaxially downwardly through the bore in tube 32 and in radially spaced relation thereto.

Suspended from the lower end of sleeve 32 in radially spaced relation to the inner peripheral surface ofhousing 14 is a bladder pump, which is denoted generally by numeral 40. Pump 40 comprises an axially-bored check valve body 42 having in its upper end a counterbore 43 threadably attached to the lower end of sleeve 32. Tube 35 extends coaxially beyond the lower end of sleeve 32, and sealingly through a pair of resilient O-rings 44 into a counterbore 45, which is formed in the reduced-diameter lower end of valve body 42. Secured in the lowr end of the counterbore 45 is a tubular fitting 46, the upper end of which has formed therein an annular valve seat 47 for a spherical ball valve or check valve 48. Valve 48 is mounted for axial movement between the valve seat 47 and a plurality of spaced rods 49, which extend transversely across the counterbore 45 adjacent its upper end.

Secured in the lower end of the bore in fitting 46 and extending coaxially downwardly therefrom in an elongate, rigid, water discharge tube 50. At is lower end tube 50 is secured in the upper end of a tubular fitting 52, the lower end of which is secured in a counterbore 53 formed in the inner end of another axially bored check valve body 54 that forms the lower end of pump 40. The bore in body 54 is normally closed by a sperical ball or check valve 55, which is movable in counterbore 53 between an annular valve seat 56 that is formed at the lower end of the counterbore, and a plurality of spaced rods 57 which extend across the counterbore adjacent its upper end.

Secured to and surrounding the upper end of tube 50 beneath fitting 46 is a tubular supporting spool 59. Between spool 59 and the lower valve body 54 the tube 50 is surrounded by a flexible, tubular bladder 61, opposite ends of which are secured sealingly around the outer peripheral surfaces of the spool 59 and an inner end of body 54 b a pair of bladder rings 62 and 63, respectively. The bladder 61 is enclosed in turn coaxially within an outer, rigid, tubular pump body 65, opposite ends of which are secured sealingly around the enlarged-diameter outer ends of the check valve bodies 42 and 54.

Figure 4:
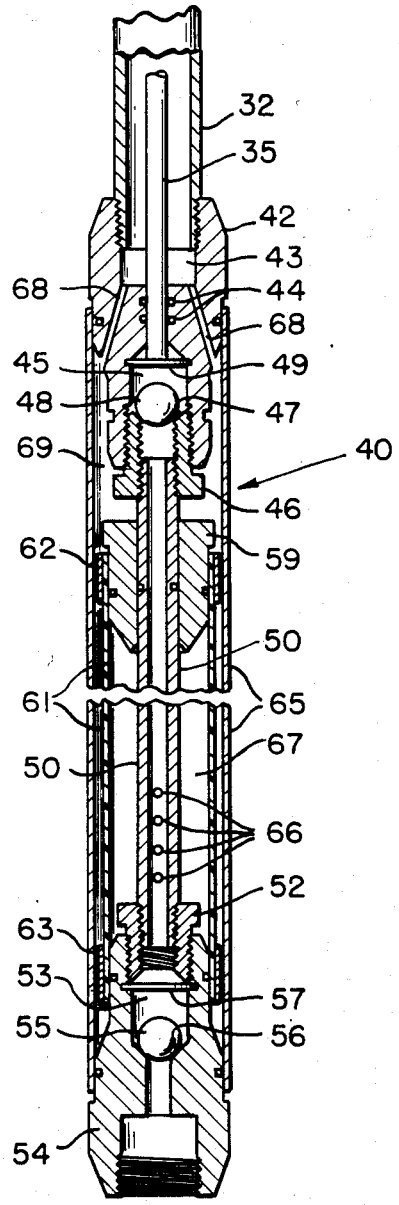
FIG. 4 is an enlarged, fragmentary longitudinal sectional view taken through the center of the bladder pump portion of the sampler as shown in FIG. 1.

As shown in FIG. 4, the discharge tube 50 has in its lower end above fitting 52 a plurality of axially spaced radial ports 66 which connect the bore of tube 50 with the annular space 67 between tube 50 and the surrounding bladder 61. Also as shown in FIG. 4, the counterbore 43 in valve body 42, which communicates with the inner or lower end of conduit 32, is connected by a plurality of diagonal ports 68 in body 42 with the annular space 69 formed in the pump housing 65 around the outside of the bladder 61.

As shown diagramatically in FIG. 1, the conventional separator 24 operates to connect the three tubular inputs 25, 26 and 27 to the three, separate output lines 25', 26' and 27', which in turn may be connected in a conventional manner to three separate valves V1, V2 and V3 of the three-way variety. Valve V1 is movable from closed position either to vent line 25' and hence tube 25 to atmosphere, or to connect line 25' and tube 25 to a supply of compressed air for purging the pump 10 as noted hereinafter. Valve V2 is operable from a closed position selectively to connect line 26' and tube 26, and hence conduit 32 (FIG. 3) and the space 69 in pump 40, either to a vacuum supply or to the compressed air supply. Valves V1 and V2 are selectively controlled by means of a conventional controller generally indicated by 28, such as the Geoguard Model 5005 manual controller. (Geoguard is a division of American Sigma, Inc.). Valve V3 is manually operable from a closed position to connect line 27' and tube 27, and hence tube 35 (FIG. 3), either to a drain for discharging purged well water, or to a receptacle for the fluid sample which is to be collected and retained.

Referring to the modified pump 10' shown in FIG. 5, it will be apparent that instead of mounting conduits 26 and 27 to extend side-by-side through tube 25 and into housing 14, they may be mounted coaxially one within the other as denoted at 126 and 127, respectively, in FIG. 5, and in turn coaxially within the purging conduit 125, which is otherwise similar to conduit 25 in the first embodiment. The advantage of the pump 10' is that it eliminates the need for employing the twin tube adaptor, since the bladder pump 40 in this embodiment will have its upper valve housing secured directly to the lower end of conduit 126.

In use, the well casing 11 extends to a depth in the ground far enough to cause the well water, or other fluid which is to be sampled, to rise in the casing above the rods 12, and for example to the level denoted by the broken line at L in FIG. 1. The sampler housing 14 is then inserted into casing 11 until the valve housing 15 is seated on the grid or screen formed by the casing rods 12. In this position the bladder pump 40 is immersed well beneath the level L of the fluid in the casing.

At this time pump housing 14 is vented to atmosphere by valve V1 so that water from within the well casing 11 enters pump 10 through the bore 17 in the valve body 15, displacing the check valve 19 upwardly, and rising within casing 14 until it also reaches the level L. Valve V3 is then moved to its drain position, and valve V1 is moved to connect line 25' with the compressed air supply, whereby air under pressure is transmitted through the tube 25 into the housing 14 around the outside of tubes 26, 27 and pump 40. This causes check valve 19 to be moved to a closed position over the bore on the valve housing 15, and causes the water or fluid thus trapped in housing 14 to be urged upwardly through the bore in the lower valve housing 54 of the water pump 40. The incoming fluid dislodges the lower check valve 55 and passes upwardly through the discharge tube 50, beyond the now-unseated check valve 48, and through the tubes 35 and 27, and the separator 24 and line 27' to the drain side of valve V3.

Thereafter valve V1 is momentarily vented to permit water once again to rise in the housing 14, after which valve V1 is again temporarily connected to the compressed air supply again to purge water in the housing 14 through the discharge tube 50 to the drain. This purging step may be repeated several times to remove stale water from the well, after which valve V1 is moved to its closed position, valve V3 is moved to a sample position, and valve V2 is alternately moved from one position to another alternately to connect line 26' to the vacuum and compressed air supplies, respectively. This intermittent pulsing of compressed air and vacuum through the line 26', tube 26, conduit 32 and ports 68 (FIG. 4) to the space 69 in the pump body 65 causes the bladder 61 repeatedly to flex radially inwardly and outwardly relative to the discharge tube 50. This pumping operation of bladder 61 causes water alternately to be drawn upwardly through the lower check valve body 54 and radial ports 66 in tube 50 to the space 67 as the bladder expands, and then to be forced out of space 67 through ports 66 to the bore in tube 50, and then since the check valve 55 is now forced to its closed position, to be forced upwardly beyond the valve 48 and through tubes 35 and 27 to the sample output of valve V3, as the bladder contracts. The operation of the bladder pump 40 may then be continued until the desired samples have been collected.

From the foregoing it will be readily apparent that the present invention provides a relatively simple and inexpensive two stage pump, which eliminates the need for employing two separate side-by-side bladder and air lift pumps, respectively, as was heretofore taught by the prior art. The advantage of using the coaxially disposed air lift and bladder pumps is that it is possible to use the pump 10 or 10' in a well casing having a very small inner diameter, for example on the order of two inches. This contrasts with prior known samplers of the type which could not use both air pumps and bladder pumps in the same well casing of this size, because of the need for mounting the two pumps in side-by-side relation.

Still another advantage of this novel two stage pump is that it is a relatively simple matter to manufacture its cylindrical housing 14 in a plurality of sections which may be releasably attachable one to the other, thereby to permit the overall length of the housing to be extended, as needed, to suit various well depths. Likewise, of course, the associated conduits 25, 26 and 27 could be made in various lengths to be releasably attachable one to the other to provide conduits of the desired length.

While the invention has been illustrated and described in connection with the use of three separate valves V1, V2 and V3 for controlling the supply of fluids to and from the conduits 25, 26 and 27, it will be readily apparent that the control valves are illustrated merely by way of example, and that various forms of known controls can be employed to effect the desired supply of fluids to and from the two stage pump 10 or 10'. Likewise, it will be apparent that the bladder pump 40 is shown merely by way of example, and that similar or alternative types of bladder pumps could be employed without departing from this invention. Furthermore, while this invention has been illustrated and described in detail in connection with only certain embodiments thereof, it will be apparent that it is capable of still further modifications as may fall within the scope of one skilled in the art or the appended claims.

We claim:

1. A two-stage pump, comprising a first pump housing having a first check valve in one end thereof disposed to be immersed in a supply of liquid, a second pump housing mounted in said first pump housing in spaced relation thereto, and having a second check valve in one end thereof, said spaced relation providing a space between said first pump housing and said second pump housing, a movable, fluid-operated pumping element in said second housing operatively dividing the interior thereof into first and second chambers, respectively, said pumping element comprising a flexible bladder enclosing said first chamber and being separated from the inner surface of said second housing by said second chamber, said first check valve being operable to permit liquid to flow unidirectionally therethrough from said supply to said space between said housings, and said second check valve being operative to permit liquid to flow unidirectionally therethrough from said space between the housings to said first chamber in said second housing, a first conduit connecting said first chamber to the exterior of said housings, a second conduit for connecting said space between said housings to a supply of fluid under pressure for use in forcing liquid from said space between the housings and successively through said second check valve, said first chamber and said first conduit to the exterior of said housings, and a third conduit for connecting said second chamber to said supply of fluid under pressure for use in operating said pumping element, thereby first to draw liquid into said first chamber from said space, and then to pump the last-named liquid through said first conduit to the exterior of said housings.

2. A two-stage pump as defined in claim 1, wherein at least portions of said first and third conduits extend through a bore provided in said second conduit.

3. A two-stage pump as defined in claim 1, wherein at least portions of said first and third conduits are disposed coaxially one within the other.

4. A two-stage pump as defined in claim 1, wherein at least portions of said first and third conduits extend in spaced, side-by-side relation to one another.

5. A two-stage pump, comprising a first pump housing having a first check valve in one end thereof disposed to be immersed in a supply of liquid, a second pump housing mounted in said first pump housing in spaced relation thereto, and having a second check valve in one end thereof, said spaced relation providing a space between said first pump housing and said second pump housing, a movable, fluid-operated pumping element in said second housing operatively dividing the interior thereof into first and second chambers, respectively, said first check valve being operable to permit liquid to flow unidirectionally therethrough from said supply to said space between said housings, and said second check valve being operative to permit liquid to flow unidirectionally therethrough from said space between the housings to said first chamber in said second housing, a first conduit connecting said first chamber to the exterior of said housings, a second conduit for connecting said space between said housings to a supply of fluid under pressure for use in forcing liquid from said space between the housings and successively through said second check valve, said first chamber and said first conduit to the exterior of said housings, a third conduit for connecting said second chamber to said supply of fluid under pressure for use in operating said pumping element, thereby first to draw liquid into said first chamber from said space, and then to pump the last-named liquid through said first conduit to the exterior of said housings, said first and third conduits being connected each at one end thereof to said second housing in communication with said first and second chambers, respectively, and and projecting at their opposite ends through the interior of said first housing and out of the end thereof opposite to the end containing said first check valve, and said second conduit being connected at one end to said opposite end of said first housing in communication with the interior thereof, and projecting at its opposite end exteriorly of said first housing.

6. A two-stage pump as defined in claim 5, wherein said pumping element is a flexible bladder enclosing said first chamber and separated from the inner surface of said second housing by said second chamber.

7. A two-stage pump as defined in claim 6, wherein said first conduit communicates adjacent said one end thereof through a third check valve with said first chamber, and said one end of said third conduit communicates directly with said second chamber.

8. A two-stage pump as defined in claim 6, wherein said one end of said third conduit is secured in the end of said second housing opposite to the end containing said second check valve, and communicates through a plurality of ports in said second housing with said second chamber, said one end of said first conduit extends in radially spaced relation through the bore in said one end of said third conduit and into said first chamber, and a third check valve is mounted in said first conduit adjacent said one end thereof to permit unidirectional flow of liquid from said first chamber to the exterior of said housings.

9. A two-stage pump as defined in claim 8, wherein said first conduit includes an elongate, rigid tube extending through said first chamber and opening at opposite ends on second and third check valves, respectively, and having in its annular wall a plurality of radial ports connecting said first chamber with the bore of said tube.

10. A two-stage pump as defined in claim 8, wherein said first and third conduits extend coaxially of each other through said first housing from said opposite end of said second housing to the exterior of said first housing.

11. A fluid sampler, comprising a first, elongate pump housing having a lower end disposed to be inserted into a supply of fluid that is to be sampled, a second pump housing mounted in said first housing, in spaced relation to its inside surface, and having a lower end positioned adjacent the lower end of said first housing, said spaced relation providing a space between said first pump housing and said second pump housing, a flexible bladder mounted in said second housing and operatively dividing the interior thereof into first and second chambers, respectively, first and second valve means mounted in the lower ends of said first and second housings, respectively, and operable to permit fluid to flow, in one direction only through the lower ends of said housings and, respectively, from said supply to said space between said housings, and from said space to said first chamber in said second housing, a first conduit connecting said first chamber to the exterior of said first and second housings, purging means for selectively supplying gas under pressure to the space between said housings to force fluid therefrom successively through said second valve means and said first conduit means to a first destination at the exterior of said housing, and sample collecting means for intermittently increasing and decreasing the pressure in said second chamber, thereby to flex said bladder and pump fluid from said space between the housings of said first chamber, and from said first chamber through said first conduit means to a second destination at the exterior of said housings.

12. A fluid sampler as defined in claim 11, wherein said first and second valve means comprise a first check valve mounted in the lower end of said first housing, and a second check valve mounted in the lower end of said second housing, and said first conduit means includes a third check valve operative to permit fluid to flow in one direction only from said first chamber toward the exterior of said housings.

13. A fluid sampler as defined in claim 12, wherein said purging means comprises a second conduit connected at one end to the upper end of said first housing to communicate with the interior thereof, and control means for selectively connecting the opposite end of said second conduit to a supply of gas under pressure.

14. A fluid sampler as defined in claim 13, wherein said sample collection means comprises a third conduit connected at one end to said second chamber and at its opposite end to said control means for connection thereby selectively to said supply of gas under pressure.

15. A fluid sampler as defined in claim 14 wherein said first and third conduits extend through said first hosuing to said control means, and to all three of said conduits extend between said first housing and said control means with two of said conduits extending through the bore in the remaining conduit.

16. A fluid sampler, comprising a tubular air lift pump housing having a first check, valve in its lower end for admitting fluid that is to be sampled, and a plug closing its upper end, a bladder pump suspended in the lift pump housing and having in its lower end a second check valve for admitting fluid from the lift pump housing to the bladder pump, a first conduit secured at one end in a bore in said plug to communicate with the interior of the lift pump housing, and connected at its opposite end to the input of a fluid separator, two additional conduits extending from the upper end of said bladder pump, through the bore in said lift pump housing, and the bore in said first conduit, to the input of said separator, one of said additional conduits being connected, at its inner end with a bladder actuating chamber in said bladder pump, and the other of said two additional conduits communicating with the fluid admitted to the bladder pump through said second check valve, means for selectively applying air under pressure through said separator to the bore in said first conduit, thereby to force fluid from said lift pump housing through said other of said two additional conduits to said separator, and means for selectively and alternately supplying air under pressure through said separator and said one of said additional conduits to said bladder actuating chamber to cause said bladder pump to pump incoming fluid to said separator.

17. A fluid sampler as defined in claim 16, where in said two additional conduits pass side-by-side one another through said lift pump housing.

18. A fluid sampler as defined in claim 16, wherein said two additional conduits extend coaxially of one another through said lift pump housing.

* * * * *

UNITED STATES PATENT AND TRADEMARK OFFICE

CERTIFICATE OF CORRECTION

PATENT NO. : 4,701,107

DATED : October 20, 1987

INVENTOR(S) : W. David DICKINSON et al

It is certified that error appears in the above-identified patent and that said Letters Patent is hereby corrected as shown below:

Column 3, line 20, change "andat" to --and at--.

Column 3, lines 33-34, change "ofhousing" to --of housing--. Column 3, line 41, correct the spelling of --lower-- (second occurrence).

Column 3, line 50, change "in" to --is--.

Column 3, line 51, change "is" to --its--.

Column 3, line 56, correct the spelling of --spherical--.

Column 3, line 68, change "b" to --by--.

Column 5, line 1, change "on" to --in--.

Column 5, line 53, after "overall" insert --axial--.

Column 7, line 59, (claim 9, line 4), after "on" insert --said--.

Column 10, line 17, change "where in" to --wherein--.

Signed and Sealed this

Twenty-sixth Day of April, 1988

*Attest:*

DONALD J. QUIGG

*Attesting Officer*

*Commissioner of Patents and Trademarks*